US009155399B1

(12) United States Patent
Zenoff

(10) Patent No.: US 9,155,399 B1
(45) Date of Patent: Oct. 13, 2015

(54) BODY PILLOW

(75) Inventor: Andrew R. Zenoff, San Francisco, CA (US)

(73) Assignee: ZENOFF PRODUCTS, San Anselmo, CA (US)

( * ) Notice: Subject to any disclaimer, the term of this patent is extended or adjusted under 35 U.S.C. 154(b) by 0 days.

(21) Appl. No.: 13/600,139

(22) Filed: Aug. 30, 2012

(51) Int. Cl.
*A47C 20/02* (2006.01)
*A47G 9/10* (2006.01)

(52) U.S. Cl.
CPC ..... *A47C 20/025* (2013.01); *A47G 9/10* (2013.01)

(58) Field of Classification Search
CPC .... A47C 20/025; A47C 20/027; A47C 16/00; A47C 20/021; A47C 20/23; A47G 9/10; A61G 2005/1045; A47D 13/08
USPC ..... 5/632, 633, 640, 631, 630, 636, 653, 5/655, 657, 652, 930, 645
See application file for complete search history.

(56) References Cited

U.S. PATENT DOCUMENTS

| | | | | | |
|---|---|---|---|---|---|
| 2,720,660 | A * | 10/1955 | Smith | 5/636 |
| 4,624,021 | A * | 11/1986 | Hofstetter | 5/632 |
| 4,901,384 | A * | 2/1990 | Eary | 5/632 |
| 5,097,551 | A * | 3/1992 | Smith | 5/652 |
| D365,241 | S * | 12/1995 | Braden et al. | D6/601 |
| 5,664,271 | A * | 9/1997 | Bellavance | 5/632 |
| 5,815,863 | A * | 10/1998 | Dolisi | 5/632 |
| 5,987,674 | A * | 11/1999 | Schaffner et al. | 5/632 |
| 6,055,687 | A * | 5/2000 | Matthews | 5/636 |
| 6,499,164 | B1 * | 12/2002 | Leach | 5/632 |
| 6,751,817 | B1 * | 6/2004 | Leach | 5/632 |
| 6,874,183 | B1 * | 4/2005 | Taylor | 5/632 |
| 6,944,898 | B2 * | 9/2005 | Matthews Brown et al. | 5/655 |
| 7,089,614 | B1 * | 8/2006 | Clapp | 5/632 |
| 7,293,310 | B1 * | 11/2007 | Hansen | 5/631 |
| 7,322,061 | B2 * | 1/2008 | Carroll | 5/630 |
| 7,331,073 | B2 * | 2/2008 | Littlehorn et al. | 5/655 |
| 7,353,552 | B2 * | 4/2008 | Leach | 5/632 |
| 7,472,443 | B2 * | 1/2009 | Littlehorn et al. | 5/632 |
| 7,513,001 | B1 * | 4/2009 | Leach | 5/655 |
| 7,540,050 | B1 * | 6/2009 | Nazer | 5/632 |
| 7,578,013 | B2 * | 8/2009 | Aikman | 5/632 |
| 7,587,773 | B2 * | 9/2009 | Littlehorn et al. | 5/655 |
| 7,793,371 | B1 * | 9/2010 | Leach | 5/632 |
| 8,074,310 | B1 * | 12/2011 | Robbins | 5/632 |
| 8,136,186 | B1 * | 3/2012 | Leach | 5/631 |
| 2005/0060806 | A1 * | 3/2005 | Wilkinson | 5/632 |
| 2007/0151031 | A1 * | 7/2007 | Leach | 5/632 |
| 2008/0148487 | A1 * | 6/2008 | Lord et al. | 5/632 |
| 2015/0040320 | A1 * | 2/2015 | Gibbons | 5/632 |

* cited by examiner

*Primary Examiner* — David E Sosnowski
*Assistant Examiner* — Eric Kurilla
(74) *Attorney, Agent, or Firm* — Siritzky Law, PLLC

(57) ABSTRACT

A pillow is provided. The pillow includes an elongated pillow extending along a single axis and a pad attached to and extending outward from a middle section of the elongated pillow. The pad is operable to support a torso of a user in a side lying position with the elongated pillow in front of the user and a portion of the pad beneath the torso.

18 Claims, 3 Drawing Sheets

BODY PILLOW

BACKGROUND

Pregnancy can cause discomfort in many aspects of life. Sometimes sleeping can be uncomfortable due to the extra body weight. Many people prefer to sleep laying on their side in a position sometimes referred to as the fetal position. The fetal position tends to be a favorable position because it allows a person's muscles to relax, and is a comfortable sleeping to position.

Multiple individual pillows or other objects are commonly utilized to support and position a person's body in the fetal position. These multiple pillows are typically placed beneath a person's head and between a person's knees to support the head and knees in the fetal position.

It is within this context that the embodiments arise.

SUMMARY

Embodiments include a pillow capable of supporting a person in a fetal position. It should be appreciated that the present exemplary embodiments can be implemented in numerous ways, such as a process an apparatus, a system, a device or a method. Several inventive embodiments of the present invention are described below.

In one embodiment, a pillow is provided. The pillow includes an elongated pillow extending along a single axis and a pad attached to and extending outward from a middle section of the elongated pillow. The pad is operable to support a torso of a user in a side lying position with the elongated pillow in front of the user and a portion of the pad beneath the torso.

In another embodiment, a side sleeping support is provided. The side-sleeping support includes a tubular pillow having a single axis extending along a length of the tubular pillow. The side sleeping support includes a wedge protruding from a side of the body pillow and a head pad affixed to an end of the tubular pillow, wherein the head pad shares the single axis Other aspects will become apparent from the following detailed description, taken in conjunction with the accompanying drawings, illustrating by way of example the principles of the exemplary embodiments.

BRIEF DESCRIPTION OF THE DRAWINGS

The invention may best be understood by reference to the following description taken in conjunction with the accompanying drawings.

DETAILED DESCRIPTION

Exemplary embodiments include monolithic body pillow configured to comfortably assist a person sleeping or laying down in a fetal position. It will be obvious, however, that the present embodiments may be practiced without some or all of these specific details. In other instances, well-known operations have not been described in detail in order not to unnecessarily obscure the exemplary embodiments.

The embodiments provide a pillow configured to support a person laying in a fetal position. The pillow is configured with a flap or extension extending from a body where the body may be cylindrically shaped. One end of the pillow has a rounded or otherwise shaped extension that has a larger diameter than the body in some embodiments. A person's head may be supported by the shaped end of the pillow, while the body of the pillow supports the body of the person. The flap or extension is configured to be placed under the belly or torso of a person and the lower portion of the pillow may be placed between the thighs and/or knees to allow the person's hip/thigh muscles to relax and to cushion the knees from rubbing against each other. As used herein, torso may refer to the lower torso of a person, i.e., the tummy or belly, in some embodiments.

Figure 1:
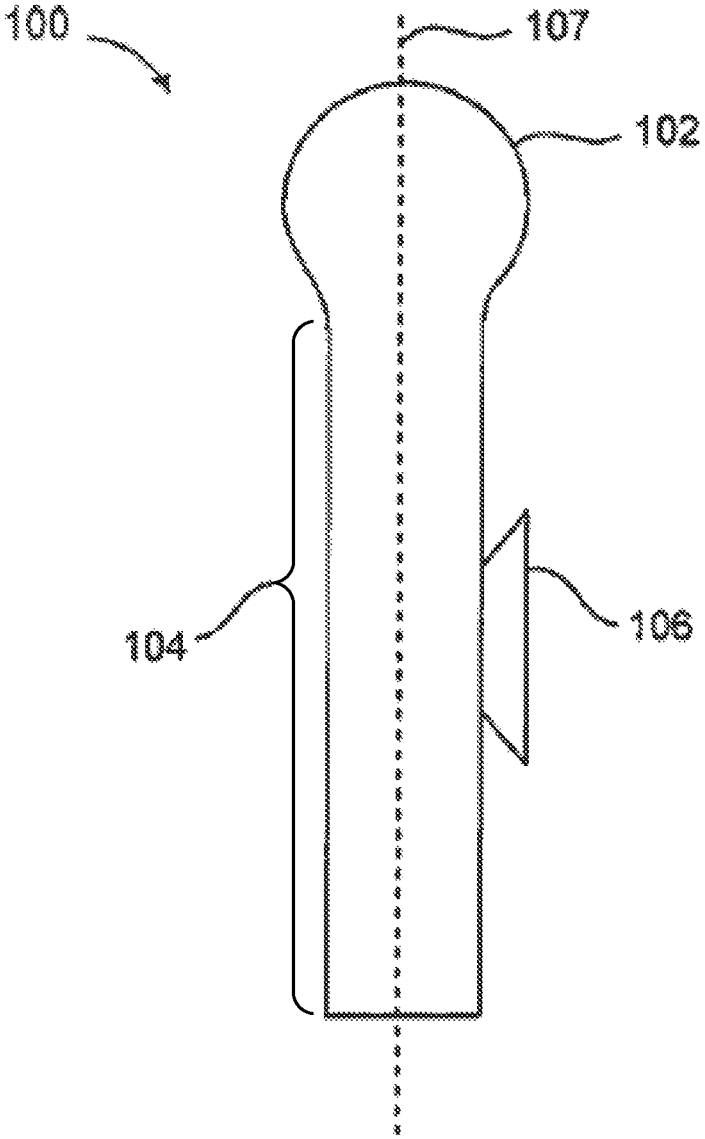
FIG. 1 is a simplified schematic diagram illustrating a top view of a body pillow in accordance with some embodiments of the invention.

FIG. 1 is a simplified schematic diagram illustrating a top view of a body pillow in accordance with some embodiments of the invention. Pillow 100 includes a head portion 102 coupled to one end of body portion 104. Body portion 104 extends from head portion 102 in a substantially straight or linear manner. In some embodiments, head portion 102 and body portion 104 extend around a single axis, i.e., axis 107. Body portion 104 is configured as a tubular pillow in some embodiments and may be referred to as an elongated pillow. Flap or extension 106 is coupled to a side surface of a middle section of body portion 102. In the embodiment illustrated with reference to FIG. 1, head portion 102 is configured having a diameter greater than a width of body portion 104. It should be appreciated that while head portion 102 is illustrated as having a circular shape, head portion 102 can have any geometric shape with a diameter or width that is greater than, equal to, or less than the width of body portion 104. Extension 106 is illustrated having a trapezoidal shape where a length of extension 106 affixed to body portion 104 is less than a length of an opposing side distal to the body portion. However, this is not meant to be limiting as extension 106 may have any suitable geometric shape and size configuration. Extension 106 may be referred to as a wedge, a pad, or a belly wedge in some embodiments. It should be appreciated that head portion 102 and extension 106 may be integral with body portion 104 or detachable from body portion 104. Pillow 100 is configured to provide head support through head portion 102, torso support through extension 106, and hip or leg support through a lower portion of body portion 104.

Figure 2:
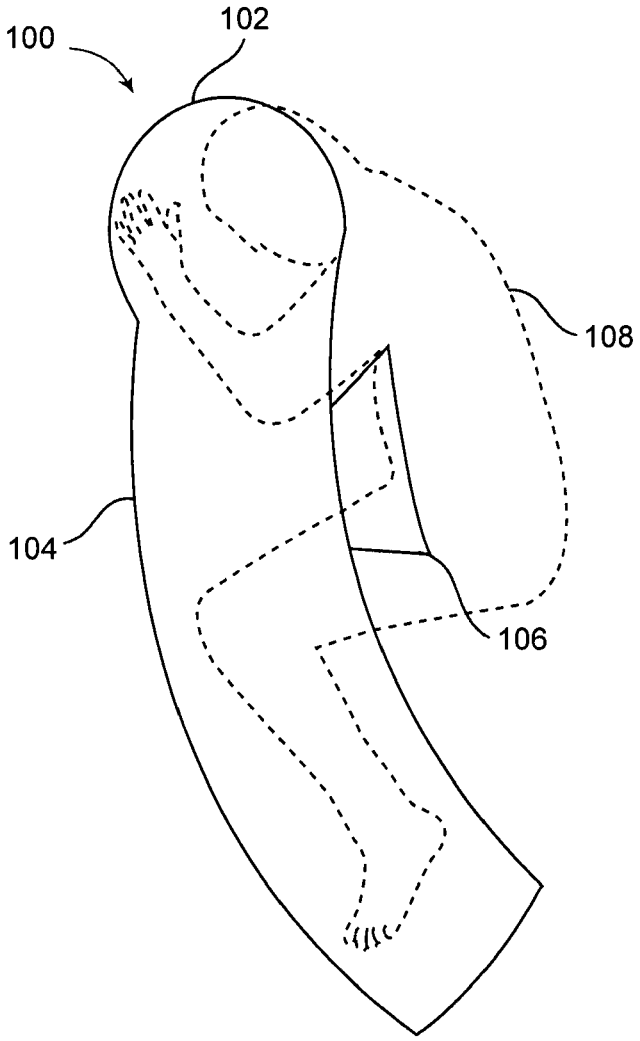
FIG. 2 is a simplified schematic diagram illustrating a person or user utilizing the body pillow in accordance with some embodiments of the invention.

FIG. 2 is a simplified schematic diagram illustrating a person or user utilizing the body pillow in accordance with some embodiments of the invention. In FIG. 2, user 108 is illustrated superimposed over the body pillow. A user's head is supported by head portion 102 while the torso or belly of user 108 is supported by extension 106. The user's legs are separated by body portion 104 in order to support the hips and to separate the user's knees and ankles from rubbing against each other in some embodiments. As illustrated in FIG. 2 pillow 100 may be conformal, i.e., body portion 104 can be curved to accommodate the user's position, so that user 108 is comfortable in a side sleeping position. Thus, head portion 102 functions as a conventional pillow to support the head of user 108. Body portion 104 conforms to support the side sleeping position of user 108, as well as provide separation of the knees and/or ankles of the user. It should be appreciated that while body portion 104 is illustrated to extend past the user's feet, this is not meant to be limiting as the user's feet may be disposed outside of body portion 104 in some embodiments. The torso of user 108 is supported through extension 106. In some embodiments, extension 106 is configured such that the proximate end affixed to body portion 104 is thicker than the distal end. The wedge configuration for extension 106 provides user 108 the torso/and or belly support, especially where user 108 is pregnant. In some embodiments pillow 100 includes a cover configured to cover body portion 104 head portion 102 and extension 106. The cover is removable in some embodiments. As noted above, head portion 102 and extension 106 may be detachable or integral with body portion 104. Pillow 100 and the removable cover may be composed of any suitable materials commonly used in the manufacture of pillows, such as commonly available soft pliable materials. These materials include cotton, synthetic materials, hypoallergenic materials, etc. Pillow 100 may be filled with materials commonly used for pillow filling, such as synthetic fillers, down material, memory foam, etc.

Figure 3:
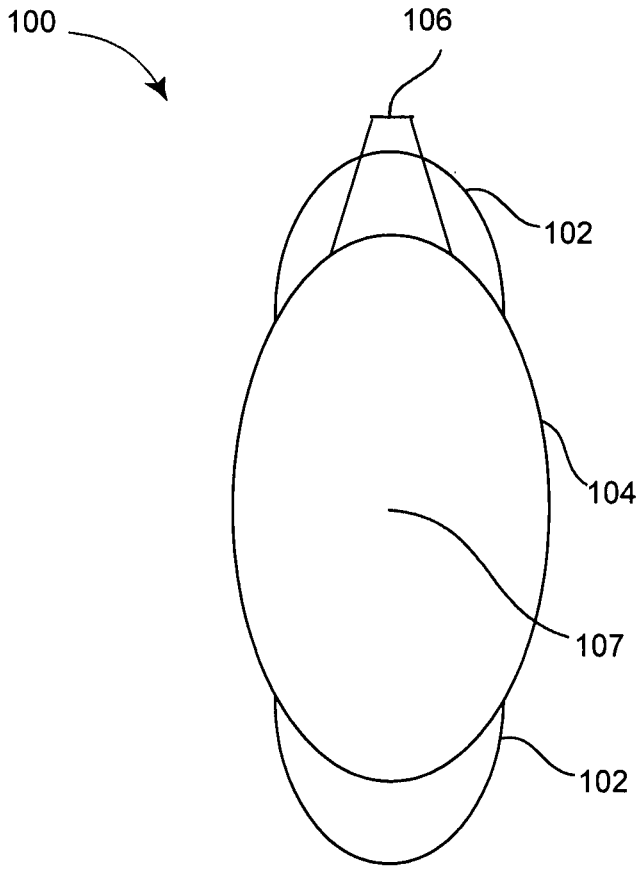
FIG. 3 is an end view of the body pillow in accordance with some embodiments of the invention.

FIG. 3 is an end view of the body pillow in accordance with some embodiments of the invention. Pillow 100 includes body portion 104, head portion 102, and extension 106. Body portion 104 is illustrated as a tubular or elliptical shape in this embodiment. It should be appreciated that this is not meant to be limiting as alternative configurations for the shape of body portion 104 are possible. For example, body portion 104 may be more circular in some embodiments. Head portion 102 is affixed to one end of body portion 104 and is illustrated as having a larger width than body portion 104. Extension 106 extends from an approximate midsection of body portion 104 in some embodiments. As illustrated in FIG. 3, extension 106 has a wedge shape where the surface proximate or affixed to body portion 104 is thicker than the distal surface of extension 106, i.e., extension 106 tapers from the surface affixed to body portion 104. As mentioned above, extension 106 can have various shapes in configurations suitable to support a torso or belly of the user when lying in a side sleeping or fetal position. In some embodiments, extension 106 is about one quarter to about one third an overall length of pillow 100. Extension 106 and/or head portion 102 may be detachable from body portion 104 through any known means. For example, common detachable configurations include snaps, zippers, Velcro, etc. In some embodiments, extension 106 or head portion 102 may be interchanged with extensions or head portions having different sizes and/or shapes. It should be appreciated that body portion 104 and head portion 102 share a common axis 107 in some embodiments. That is, body portion 104 is substantially straight or linear so that body portion 104 has a single axis 107. It should be further appreciated that while body portion 104 has a single axis 107, body portion 104 may be compliant or flexible so that the body portion can be curved to conform to a comfortable sleeping position and still have a single axis.

The embodiments provide for a pillow suited to provide head leg and torso support. The torso support is especially helpful for pregnant users. The pillow makes sleeping more comfortable by conforming to the user's body position throughout the night. The versatile and compliant shape of the pillow allows the user to adjust the support as the user's body changes by switching which side the user utilizes to align their hips. The streamlined design enables maximum support and minimal use of bed space. The head, belly/torso and knees are specifically supported for a comfortable, ideal sleep position. The wedge or extension enables maximum support during sleep, and the streamlined design takes up less space than traditional body pillows.

Although the foregoing invention has been described in some detail for purposes of clarity of understanding, it will be apparent that certain changes and modifications can be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A body pillow comprising:

an elongated pillow extending along a single axis, wherein the elongated pillow has substantially straight sides, wherein the substantially straight sides include sides parallel to the axis;

a substantially rounded head pad directly attached to an end of the to elongated pillow operable to support a head of a user, the rounded head pad sharing the single axis with the elongated pillow; and a pad having a trapezoidal shape and attached to and extending outward from a middle section of the elongated pillow, the pad operable to support a torso of the user in a side lying position with the elongated pillow in front of the user and a portion of the pad beneath the torso, the pad thicker where attached to the elongated pillow than where distal to the elongated pillow when the body pillow is unused.

2. The body pillow of claim 1 further comprising a removable cover disposed over the elongated pillow and the pad.

3. The body pillow of claim 1 wherein the pad is detachable from the middle section of the elongated pillow.

4. The body pillow of claim 1 wherein the pad is integral with the elongated pillow.

5. The body pillow of claim 1 further comprising a filling material, wherein the elongated pillow and the pad are filled with a same type of the filling material.

6. The body pillow of claim 1 wherein the pad tapers from a thickness approximately equal to a middle section thickness of the elongated pillow, in a portion of the pad proximate to the elongated pillow, to a thickness in a portion of the pad distal to the elongated pillow.

7. The body pillow of claim 1 wherein the pad has a shorter running length at a base where attached to the middle section of the elongated pillow than at a tip edge distal to the elongated pillow.

8. A side-sleeping support comprising:

a tubular pillow having a single axis extending along a length of the tubular pillow, the tubular pillow having substantially straight sides parallel to the axis;

a wedge having a trapezoidal shape and protruding from a side of the tubular pillow, the wedge tapering from a thicker portion proximate to the tubular pillow to a thinner portion distal to the tubular pillow when the side-sleeping support is unused; and a substantially round head pad affixed to an end of the tubular pillow, the to head pad sharing the single axis, the head pad operable to support a head of a user, wherein the head pad is directly coupled to the end of the tubular pillow.

9. The side-sleeping support of claim 8 further comprising a washable slipcover that removably covers the tubular pillow, the wedge, and the head pad.

10. The side-sleeping support of claim 8 wherein the head pad is wider than at least one section of the tubular pillow.

11. The side-sleeping support of claim 10 wherein the tubular pillow can curve such that a side-sleeping user can:

receive head support from the head pad;

receive torso support from the wedge; and have knees straddling a lower portion of the tubular pillow.

12. The side-sleeping support of claim 8 further comprising at least one fastener attaching the wedge to the tubular pillow, wherein the wedge is removable.

13. The side-sleeping support of claim 8, wherein the tubular pillow is between about 4 feet to 7 feet in length.

14. The side-sleeping support of claim 8 wherein at least one portion of the wedge is thinner than at least one portion of the tubular pillow.

15. The side-sleeping support of claim 8 wherein an overall length of the wedge is about one sixth to one third an overall length of the tubular pillow.

16. A side-sleeping support comprising:

a tubular pillow having a single axis extending along a length of the tubular pillow, the tubular pillow having substantially straight sides parallel to the axis, the tubular pillow being between about 4 feet and 7 feet in length;

a wedge having a trapezoidal shape and protruding from a side of the tubular pillow, the wedge tapering from a thicker portion proximate to the tubular pillow to a thinner portion distal to the tubular pillow when the side-sleeping support is unused, wherein at least one portion of the wedge is thinner than at least one portion of the tubular pillow, and wherein an overall length of the wedge is about one sixth to one third an overall length of the tubular pillow; and a substantially round head pad affixed to an end of the tubular pillow, the head pad sharing the single axis, the head pad operable to support a head of a user, wherein the head pad is directly coupled to the end of the tubular pillow; and a washable slipcover that removably covers the tubular pillow, the wedge, and the head pad, wherein the head pad is wider than at least one section of the tubular pillow.

17. The support of claim 16 wherein the wedge is detachable from the middle section of the elongated pillow.

18. The support of claim 16 wherein the wedge is integral with the elongated pillow.

* * * * *